US009707429B2

(12) United States Patent
Hugou et al.

(10) Patent No.: US 9,707,429 B2
(45) Date of Patent: Jul. 18, 2017

(54) DYNAMIC PENDULA STOOL

(71) Applicant: ACTIVE BASE, Luxembourg (LU)

(72) Inventors: Olivier Hugou, Antibes (FR); Guilbault Colas, La Tronche (FR)

(73) Assignee: ACTIVE BASE, Luxembourg (LU)

( * ) Notice: Subject to any disclaimer, the term of this patent is extended or adjusted under 35 U.S.C. 154(b) by 0 days.

(21) Appl. No.: 14/923,122

(22) Filed: Oct. 26, 2015

(65) Prior Publication Data

US 2016/0038780 A1 Feb. 11, 2016

Related U.S. Application Data

(63) Continuation-in-part of application No. PCT/FR2014/051009, filed on Apr. 25, 2014.

(30) Foreign Application Priority Data

Apr. 25, 2013 (FR) ..... 13 00965
Oct. 25, 2013 (FR) ..... 13 60472

(51) Int. Cl.
*A63B 21/002* (2006.01)
*A47C 3/029* (2006.01)
(Continued)

(52) U.S. Cl.
CPC ..... *A63B 21/0023* (2013.01); *A47C 3/029* (2013.01); *A47C 3/28* (2013.01);
(Continued)

(58) Field of Classification Search
CPC .. A47C 3/029; A47C 3/28; A47C 3/40; A47C 7/004; A47C 9/002; A47C 9/025;
(Continued)

(56) References Cited

U.S. PATENT DOCUMENTS 4,130,263 A * 12/1978 Roericht ..... A47C 9/025 248/158
5,590,930 A * 1/1997 Glockl ..... A47C 3/0257 297/258.1
(Continued)

FOREIGN PATENT DOCUMENTS

DE 190 229 C 10/1907
DE 2 314 717 A1 10/1974
(Continued)

OTHER PUBLICATIONS

International Search Report (PCT/ISA/210) mailed on Jul. 18, 2014, by the Japanese Patent Office as the International Searching Authority for International Application No. PCT/FR2014/051009.
(Continued)

*Primary Examiner* — Andrew S Lo
(74) *Attorney, Agent, or Firm* — Buchanan Ingersoll & Rooney PC

(57) ABSTRACT

Disclosed herein is a dynamic pendula stool possessing a foot, a leg secured to the foot, and a seat secured to the top end of the leg. The leg has a telescopic column that includes a lower part secured to a spherical foot with a diameter of 20-cm or less and an upper part with a free end having an articulation. The articulation has three degrees of freedom and is secured to the underside of the seat so that when a user rests against the seat, the leg forms an angle between 30 and 90 degrees with respect to the horizontal, thereby allowing an isometric contraction of the muscle groups of the lower limbs and of the abdominal girdle in the seated position. The stool is further provided with one or more sensors configured to send data signals to a remote electronic device.

22 Claims, 6 Drawing Sheets

(51) Int. Cl.

| | |
|---|---|
| ***A47C 9/00*** | (2006.01) |
| ***A47C 9/02*** | (2006.01) |
| ***A63B 21/00*** | (2006.01) |
| ***A47C 3/28*** | (2006.01) |
| ***A47C 3/40*** | (2006.01) |
| ***A47C 7/00*** | (2006.01) |
| ***A63B 23/02*** | (2006.01) |
| ***A63B 23/04*** | (2006.01) |

(52) U.S. Cl.
CPC ..... *A47C 3/40* (2013.01); *A47C 7/004* (2013.01); *A47C 9/002* (2013.01); *A47C 9/025* (2013.01); *A63B 21/4029* (2015.10); *A63B 23/0205* (2013.01); *A63B 23/04* (2013.01); *A63B 2208/0233* (2013.01); *A63B 2220/16* (2013.01)

(58) Field of Classification Search
CPC ..... A63B 21/002; A63B 21/0023; A63B 21/4029; A63B 2208/0233; A63B 2220/16; A63B 23/00; A63B 23/0205; A63B 23/04
USPC ..... 482/8
See application file for complete search history.

(56) References Cited

U.S. PATENT DOCUMENTS

| | | | | |
|---|---|---|---|---|
| 5,673,966 | A | 10/1997 | Morton, Jr. | |
| 5,921,628 | A * | 7/1999 | Glockl | A47C 9/002 297/338 |
| 6,666,802 | B1 * | 12/2003 | Rasmussen | A63B 21/0608 482/140 |
| 6,997,511 | B2 * | 2/2006 | Marchand | A47C 9/025 297/313 |
| 7,156,790 | B2 * | 1/2007 | Johnsen | A63B 21/0004 482/112 |
| 8,136,876 | B2 * | 3/2012 | Bellvis Castillo | A47C 9/002 297/195.11 |
| 8,403,408 | B2 * | 3/2013 | Hosler | A47C 9/025 297/4 |
| 8,998,319 | B2 * | 4/2015 | Bahneman | A47C 9/00 297/195.11 |
| 9,010,867 | B2 * | 4/2015 | Martin | A47C 3/029 297/271.5 |
| 9,474,377 | B2 * | 10/2016 | Keen | A47C 7/506 |
| 2003/0164633 | A1 | 9/2003 | Jakus et al. | |
| 2004/0130452 | A1 * | 7/2004 | Cherubini | G08B 21/22 340/573.7 |
| 2007/0138850 | A1 * | 6/2007 | Oettinger | A47C 3/029 297/271.5 |
| 2008/0097256 | A1 * | 4/2008 | Torres | A61G 5/045 601/24 |
| 2008/0242521 | A1 * | 10/2008 | Einav | A61B 5/1116 482/110 |
| 2009/0001788 | A1 * | 1/2009 | Lenz | A47C 9/002 297/217.4 |
| 2013/0267391 | A1 * | 10/2013 | Todd | A63B 21/00116 482/97 |
| 2015/0038301 | A1 * | 2/2015 | Todd | A63B 23/0216 482/97 |

FOREIGN PATENT DOCUMENTS

| | | |
|---|---|---|
| DE | 44 24 932 A1 | 1/1996 |
| DE | 195 33 558 C1 | 11/1996 |

OTHER PUBLICATIONS

Written Opinion (PCT/ISA/237) mailed on Jul. 18, 2014, by the Japanese Patent Office as the International Searching Authority for International Application No. PCT/FR2014/051009.

* cited by examiner

DYNAMIC PENDULA STOOL

FIELD OF THE INVENTION

The present invention relates to a dynamic pendula stool allowing an isometric contraction of the muscle groups of the lower limbs and the abdominal girdle in a seated position.

BACKGROUND OF THE INVENTION

In the field of seats or similar, like stools, it is well known that office chairs are often designed so that the body is supported in an ideal sitting position, where anatomical stresses are prevented in order to guarantee the user's comfort. These chairs are made of a frame with a cushion and a seatback. The seatback may be articulated to the frame with a return spring device to improve the comfort of the seat.

Such office chairs have the shortcoming of not exerting the muscles of the legs and of the back, which means that their users risk the degeneration of the spinal muscles and vertebral damages, such as wearing of the discs due to poor posture.

For good posture, it is well known to use a "Pezzi®" ball, for example. The user can sit on Pezzi® balls and use the muscles of the legs and the back.

However, the Pezzi® balls are particularly cumbersome, i.e., they are especially unsuitable for use in an office.

Many gymnastics devices are known, such as bicycles, leg presses and rowing machines, etc., to work the muscles of the legs and the abdominal muscles. However, in addition to not being usable at the office, these devices have the shortcoming of requiring movements, which restricts their use, either because the user will lack mobility or because of space requirements.

Devices are known, like electrostimulation, which allow isometric contraction of the muscles of the legs and of the abdominal muscles. However, they are difficult to use, particularly at the office, notably because putting the electrodes in place requires undressing in particular.

Many dynamic seats and stools have been designed to overcome all these shortcomings. They notably include the German patent applications DE 2314717 and DE 19533558.

German patent application DE 2314717 describes a stool with two ball and socket joints with springs, wherein the user is in a state of unstable balance, such that he can return to a normal position by means of a lateral deviation with actions by his legs.

German patent application DE 19533558 describes an active dynamic stool with a leg, whose base surface is an upward concavity curve, which allows a tilting movement, with a column secured to the leg, and a seat mounted on a fulcrum at the upper end of said column. The curved base surface of the leg lies directly on the ground and has a spherical curve on at least a partial zone. The seat is mounted at its fulcrum so that it can tilt to any side. Said fulcrum is either located under the center of the curvature of the base surface, or can be adjusted within a range of height values, whose lower limit is located under the center of the curvature. The seat is mounted on a junction element made of an elastic item that works as a spring and lies on a strut secured to the upper end of the column.

All these devices have the common shortcoming of being cumbersome and not allowing the isometric contraction of the muscle groups of the lower limbs, in particular.

SUMMARY OF THE INVENTION

One of the goals of the invention is to overcome these shortcomings by offering a dynamic pendula stool with a simple and inexpensive design that allows the isometric contraction of the muscle groups of the lower limbs and of the abdominal girdle in a seated position.

For this purpose, according to the invention, there is provided a dynamic pendula stool with a foot, a column secured to said foot and a seat secured to the upper end of said column, characterized in that the column is made of a telescopic column with a lower part secured to a spherical foot with a diameter of 20 cm or less and an upper part, whose free end has an articulation with three degrees of freedom and is secured to the lower face of the seat, so that, when a user bears on the seat, the column forms an angle between 30° and 90° with the horizontal, which allows the isometric contraction of the muscle groups of the lower limbs and of the abdominal girdle in a seated position.

Unlike the devices of the prior art, it is clear that the device according to the invention is very space-saving and allows periodic use, in place of a traditional office chair, or continuous use, and that it provides the isometric contraction of the muscle groups of the lower limbs and of the abdominal girdle in a seated position. From this point of view, it should be noted that the smaller the angle between the column and the horizontal, the stronger the work by the muscle groups of the lower limbs.

Beneficially, the spherical foot is made of a non-slip material, preferably an elastomeric material.

In addition, the spherical foot includes a radially extending sleeve with an internal thread in cooperation with a threaded rod that is secured to the lower end of the lower part of the column.

Said articulation is made of a ball and socket joint or a universal joint (Cardan joint).

In addition, the upper end of the lower part of the column includes a quick-release clamp.

Incidentally, said seat has an approximately parallelepiped shape.

BRIEF DESCRIPTION OF THE DRAWINGS

Other advantages and characteristics will become apparent from the following description of a single embodiment, given as a non-limitative example, of the dynamic pendula stool according to the invention, with reference to the appended drawings, in which.

DETAILED DESCRIPTION

In the following, the same numbers refer to the same items. In addition, the various views, in particular the longitudinal section view, are not necessarily to scale.

Figure 1:
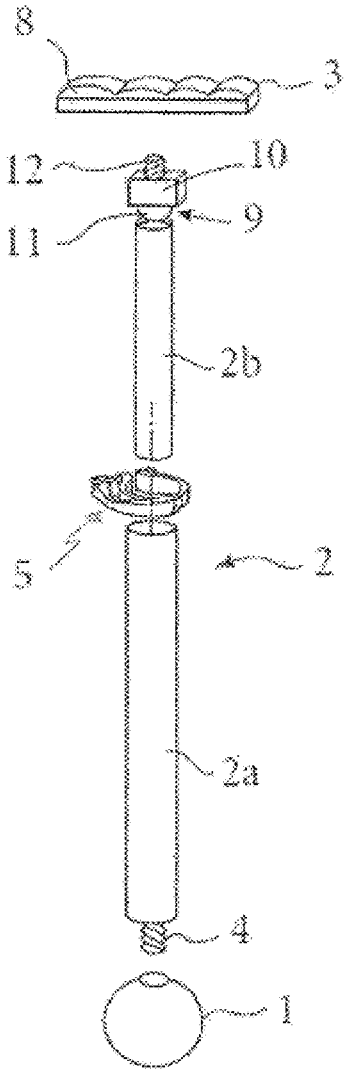
FIG. 1 is an exploded perspective view of the dynamic pendula stool according to the invention.
Figure 2:
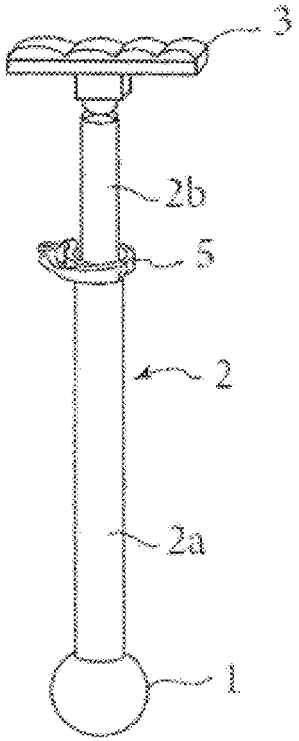
FIG. 2 is a perspective view of the dynamic pendula stool according to the invention.
Figure 3:
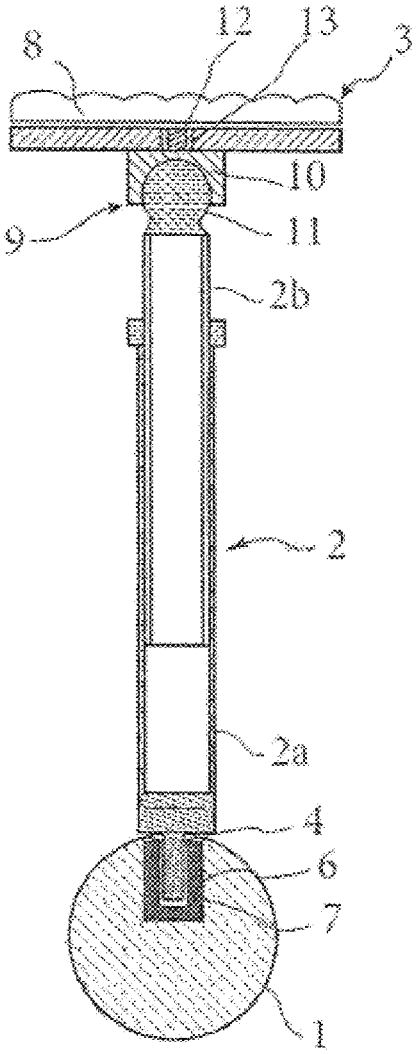
FIG. 3 is a longitudinal section view of the dynamic pendula stool according to the invention.

In reference to FIGS. 1 to 3, the dynamic pendula stool according to the invention is made of a foot (1), a column (2) secured to said foot (1) and a seat (3) secured to the upper end of said column (2). Said column (2) is made of a telescopic column with a so-called lower part (2*a*) secured to the foot (1) and a so-called upper part (2*b*). In this particular embodiment, the telescopic column (2) is made of two tubes with circular sections, a first tube being the lower part (2*a*) with a threaded rod (4) at the lower end, extending co-axially from said tube, and at the upper end, of a quick-release clamp (5) and a second tube being the upper part (2*b*), said second tube having an external diameter slightly smaller than the internal diameter of the tube of the upper part, so that the upper part (2*b*) can slide into the lower part (2*a*) to adjust the length of the column according to the morphology of the user and/or the desired difficulty of the work by the muscles of the lower limbs, as detailed below. In a well-known way, the quick-release clamp (5) consists of a substantially annular open piece, whose open ends are linked by a tie rod with one end cooperating with clamping and traction means under tension of said tie rod. Said clamping and traction means are made of a handle with a cylinder head rotatively mounted around an eccentric axle parallel to the axle of the tubes. Incidentally, the tubes of the lower part (2*a*) and the upper part (2*b*) are beneficially made of an aluminum alloy or any other light metal alloy well known to those skilled in the art, so that the stool according to the invention is as light as possible.

It is evident that the telescopic column (2) may be substituted by any other telescopic column well-known to those skilled in the art, without going beyond the scope of the invention.

Furthermore, said foot (1) has a spherical shape in a non-slip material, preferably an elastomeric material, to prevent the stool according to the invention from slipping on smooth grounds, like tiling. Said elastomeric material may be any well-known natural and/or synthetic elastomer like, for example, natural rubber, synthetic polyisoprene, polybutadiene or styrene-butadiene copolymer. Said elastomer preferably has a Shore hardness value of 40 or more to prevent crushing of said foot (1). Furthermore, the spherical foot (1) includes a radially extending sleeve (6) with an internal thread (7) in cooperation with a threaded rod (4) that is secured to the lower end of the lower part (2*a*) of the column (2). Preferably, said spherical foot (1) has a diameter of 20 cm or less to limit the weight of the stool and allow greater angular variability.

In addition, the seat (3) has an approximately parallelepiped shape with a width substantially equal to that of the pelvis of a person of average size. The upper part of said seat (3) includes a resilient layer (8) for improved comfort. Said seat is articulated to the upper end of the upper part (2*b*) of the column (2) with an articulation (9) with three degrees of freedom.

In this embodiment, said articulation is a ball and socket joint with a joint seat (10) secured to the lower face of the seat (3), in its central part, and receiving a ball and socket joint (11) secured to the free upper end of the upper part (2*b*) of the column (2). Advantageously, the joint seat (10) of the articulation (9) is secured to the seat (3) with a threaded rod (12) secured to said joint seat (10) and in cooperation with a screw thread (13) inside said seat (3). This way, it is possible to change the seat (3) quickly according to the user's preferences, in particular.

It is evident that the ball and socket joint may be substituted by any other ball joint well known to those skilled in the art, like a universal joint (Cardan joint) or similar, without going beyond the scope of the invention.

Furthermore, it is evident that the seat (3) may have any shape and/or have a lateral or front handle without going beyond the scope of the invention.

Incidentally, the stool according to the invention can also include a damping system, such as a gas piston or spring inserted into the lower part (2*a*) and/or the upper part (2*b*) of the column (2) for improved ease of use of the stool according to the invention.

Figure 4:
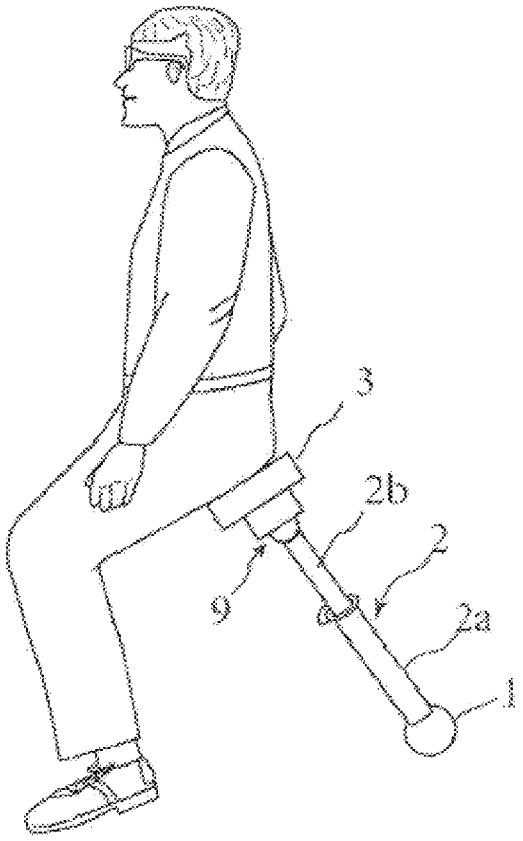
FIG. 4 is a perspective view of a user sitting onto the dynamic pendula stool according to the invention.

The following will explain how the stool according to the invention works, in reference to the FIG. 4.

The user will adjust the length of the column (2) in advance, then he positions the seat (3) under his buttocks with the foot (1) lying on the ground. This way, the column (2) forms an angle between 30° and 90° with the horizontal, said angle varying according to the user's size and the selected length of said column (2). It should also be noted that the smaller the angle between the column and the horizontal, the stronger the work by the muscles of the lower limbs. In this position of use, the stool according to the invention causes an isometric contraction of the gastrocnemius muscles, Ischia hamstrings, quadriceps, glutes, lower back and dorsal apsidal muscles. The isometric contraction results from the user exerting proprioception and equilibration to compensate for the instability of the stool. Indeed, the articulation of the seat (3) on the column (2) and the only fulcrum of the spherical foot (1) provide a lateral front and back tilting that requires the user to have a stable position, where the line between the shoulders is parallel to that of the pelvis, a bearing on the feet causing the isometric contraction of the muscles of the lower limbs and an unstable gluteal support that will be compensated by the proprioception and the contraction of the lumbar and abdominal muscles.

Figure 5:
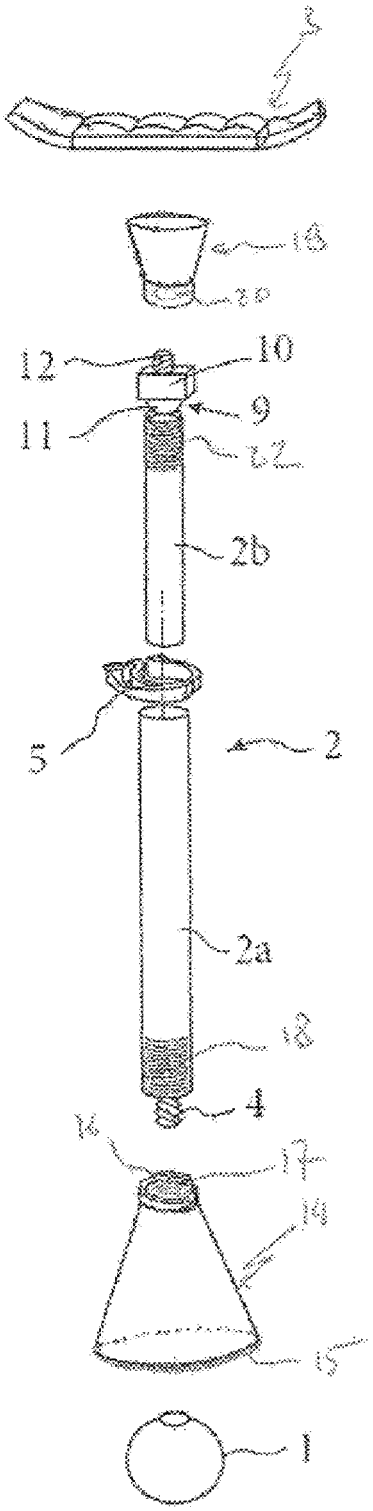
FIG. 5 is an exploded view of an embodiment of the dynamic pendula stool according to the invention.
Figure 6:
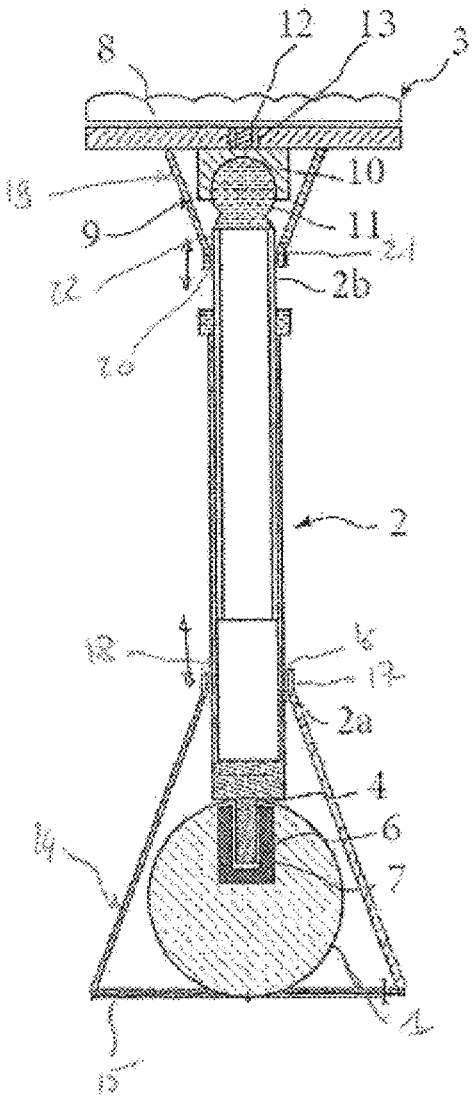
FIG. 6 is a longitudinal section view of the embodiment of the dynamic pendula stool according to the invention as in FIG. 5.

According to an embodiment of the dynamic pendula stool according to the invention in reference to FIGS. 5 and 6, as previously, said stool is made of a foot (1), a column (2) secured to said foot (1) and a seat (3) secured to the upper end of said column (2). Said column (2) consists of a telescopic column with a so-called lower part (2*a*) secured to the foot (1) and a so-called upper part (2*b*). The telescopic column (2) is made of two tubes with circular sections, a first tube being the lower part (2*a*) with a threaded rod (4) at the lower end, extending coaxially from said tube and, at the upper end, of a quick-release clamp (5), and of a second tube forming the upper part (2*b*), said second tube with an external diameter slightly smaller than the internal diameter of the tube from the upper part, so that the upper part (2*b*) can slide into the lower part (2*a*) to adjust the length of the column according to the morphology of the user and/or the desired difficulty of the work by the muscles of the lower limbs.

In a well-known manner, the quick-release clamp (5) consists of a substantially annular open piece, whose open ends are linked by a tie rod with one end cooperating with clamping and traction means under tension of said tie rod. Said clamping and traction means are made of a handle with a cylinder head rotatively mounted around an eccentric axle parallel to the axles of the tubes.

Furthermore, said foot (1) has a spherical shape in a non-slip material, preferably an elastomeric material, to prevent the stool according to the invention from slipping on smooth floors, like tiling. Said elastomeric material may be any well-known natural and/or synthetic elastomer like, for example, natural rubber, synthetic polyisoprene, polybutadiene or styrene-butadiene copolymer. Said elastomer preferably has a Shore hardness value of 40 or more to prevent crushing of said foot (1). Furthermore, the spherical foot (1) includes a radially extending sleeve (6) with an internal thread (7) in cooperation with a threaded rod (4) that is secured to the lower end (2*a*) of the column (2). Preferably, said spherical foot (1) has a diameter of 20 cm or less to limit the weight of the stool and allow greater angular variability.

The seat (3) has a curved and ergonomic shape, whose width is substantially equal to that of the pelvis of a person of average weight. Said seat (3) is articulated at the upper end of the upper part (2*b*) of the column (2) by an articulation (9) with three degrees of freedom. In this embodiment, said articulation consists of a ball and socket joint with a joint seat (10) secured to the lower side of the seat (3), in its central part, and receiving a ball and socket joint (11) secured to the free upper end of the upper part (2*b*) of the column (2). Advantageously, the joint seat (10) of the articulation (9) is secured to the seat (3) by a threaded rod (12) secured to said joint seat (1) and in cooperation with a thread (13) inside said seat (3). This way, it is possible to change the seat (3) quickly according to the user's preferences, in particular.

This embodiment is particularly distinguished from the previous one by the stabilizer cone (14) of the column (2), which is made in one piece with a substantially frustoconical shape, made of a plastic or similar material, and with the peripheral edge of the larger base—said larger base being the lower part of the stabilizer cone (14)—including an anti-slip annular elastomeric seal (15), and with the smaller base—said smaller base being the upper end—including a central bore (16) with an internal thread (17) capable of cooperating with a thread (18) at the lower end of the lower part (2*a*) of the column (2). This way, by screwing said stabilizer cone (14) to the lower end of the lower part (2*a*) of the column (2), the user can set the position of said stabilizer cone (14) so that it covers the spherical foot (1). Thus, the anti-slip annular elastomeric seal (15) bears on the ground and the spherical foot (1) is no longer in contact with said ground, which guarantees the stability of the stool. Such a position may be adopted when the stool is not used in particular. When screwing the stabilizer cone (14) more, it slides along the column (2) upward until the anti-slip annular elastomeric seal is no longer in contact with the ground and the spherical foot (1) is uncovered enough to make the stool unstable again.

Furthermore, the stool includes a second so-called seat (3) locking cone (19). This locking cone (19) consists of a substantially frustoconical piece made of a plastic or similar material, with the peripheral edge of the larger base—said larger base being the upper part of the locking cone (19)—capable of bearing on the lower side of the seat (3), and with the smaller base—said smaller base being the lower end—including a central bore (20) with an internal thread (21) capable of cooperating with a thread (22) at the upper end of the upper part (2*b*) of the column (2). Thus, by more or less screwing said locking cone (19), a user can prevent any rotation of the seat (3) relative to the column (2) when the peripheral edge of the larger base of the cone (19) bears on the lower side of the seat (3) or, to the contrary, the user can allow the rotation of the seat (3) relative to the column (2) when the cone (19) is so lowered that the larger base of the cone (19) does not bear on the lower side of said seat (3).

Incidentally, the column (2) and/or the seat (3) may include a position sensor, for example an accelerometer, or any other position sensor well known to those skilled in the art, in connection with a wireless communication means, such as a Bluetooth®, WiFi or similar transmitter. This way, the position of the column (2) and/or of the seat (3) may be transmitted to a smartphone-type cellular phone and/or to a tablet computer and/or to a PC-type computer including a computer program capable of displaying the actual position of the column (2) and/or of the seat (3) in reference to an ideal preset position.

Figure 7:
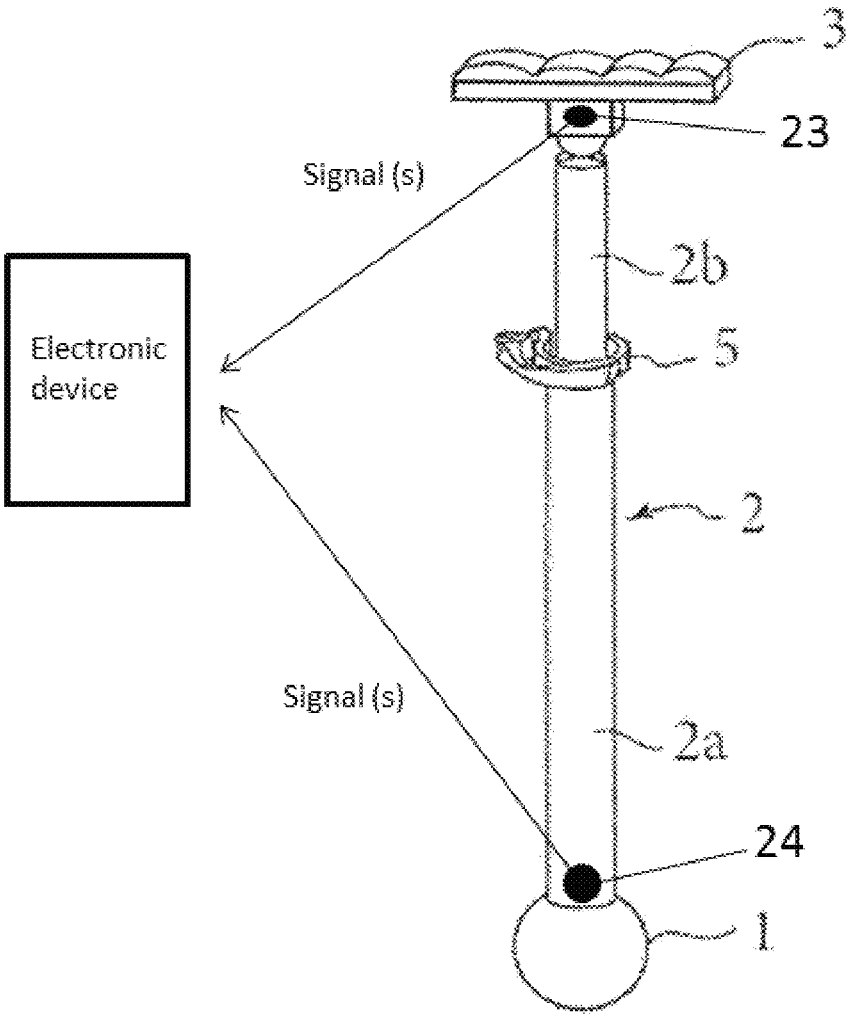
FIG. 7 is a perspective view of the dynamic pendula stool in communication with a remote electronic device.

As shown in FIG. 7, the stool may also include one or more sensors (23, 24) configured to send data signals to a remote electronic device, such as the previously referenced smartphone, computer, digital tablet, or the like. The data signals, including information, from the one or more sensors may be transmitted to the remote electronic device by means of fixed or wireless communication, including but not limited to, WiFi or Bluetooth®. A non-transitory computer-readable medium may be provided for storing a program which causes the remote electronic device to execute particular steps to manipulate the transmitted data signals and the information contained therein. The remote electronic device processes the received data signals to convert the information contained therein into a command signal(s). The data signals sent from the stool to the remote electronic device may be used for validation and/or to direct movement(s) of the stool by the user.

In another aspect of the present disclosure, the data signals transmitted to the remote electronic device are used to direct movement of the stool for therapeutic purposes. Particularly, the command signals may be tailored based on the transmitted data signals to validate the positioning and/or movement of the stool in order speed up the physical therapy of the user.

The one or more sensors are not particularly limited, but will vary depending on desired functionality and placement on the stool. The following are non-exhaustive examples of sensors that can be used in combination with any embodiment of the pendula stool described herein.

Any one or more of an accelerometer, a gyroscope, and a gyrometer may be used as a position sensor or position detector. Such position sensors are preferably positioned on the column (2) of the stool, but may be located on other areas of the stool as well. Data collected from the position sensor(s) are then used to determine the position of the stool in relation to predefined reference points, such as the ground. The data may also be used to determine the angle(s) that define the direction of and/or the speed of movement of the stool.

A pressure sensor, such as a piezometer, can be included on the stool, preferably on the spherical foot (1). Data obtained from the pressure sensor reflect a load bearing on the stool and can be utilized to identify an active use period of the stool. Similarly, a pressure sensor can also be incorporated on the stabilizer cone (4) of the stool. The data obtained from the pressure sensor positioned at the stabilizer cone (2) is useful for identifying the optimal position of the stool while in use that is specific to each individual user.

In one non-limiting example, the stool includes a pressure sensor located below either the seat (3) or the articulation (9). In this case, the pressure sensor is configured to detect a load applied to the stool. More specifically, the pressure sensor may be configured to detect when a load applied to the stool exceeds a predetermined threshold or alternatively to detect a particular pressure (i.e., when a double pressure is applied to the seat). Further, the loads detected by the pressure sensors are transmitted to the remote electronic device. When the electronic device receives the data signal(s) of the detected load(s) from the stool, the signal activates a particular menu or application stored on the electronic device. It is also contemplated for certain embodiments that a load(s) must be detected in order for a user input into the remote electronic device to be accepted. In other words, if the remote electronic device does not receive data signal(s) from the stool, then the user will be unable to operate a particular menu or application on the remote electronic device. A second sensor is positioned on or in the column (2) or the spherical foot (1) to detect a tilt or inclination of the stool. The tilt or inclination values obtained by the second sensor may also be used by the remote electronic device to scroll a menu on the remote electronic device, e.g., to indicate the angle of inclination in degrees.

All of the sensors described herein are configured to continuously collect and transmit information to the remote electronic device. Thus, data is captured with respect to the user's movement while on the stool regardless of the user's awareness. The data transmitted to the remote electronic device contains information pertaining to the position and/or tilt of the stool. This data capture arrangement facilitates the generation of a movement profile for a user employing the stool. The remote electronic device processes the received data from the sensors to determine the discrete position of the stool and the progression of movement of the stool. The remote electronic device can also calculate center of gravity based on the received data.

Figure 8:
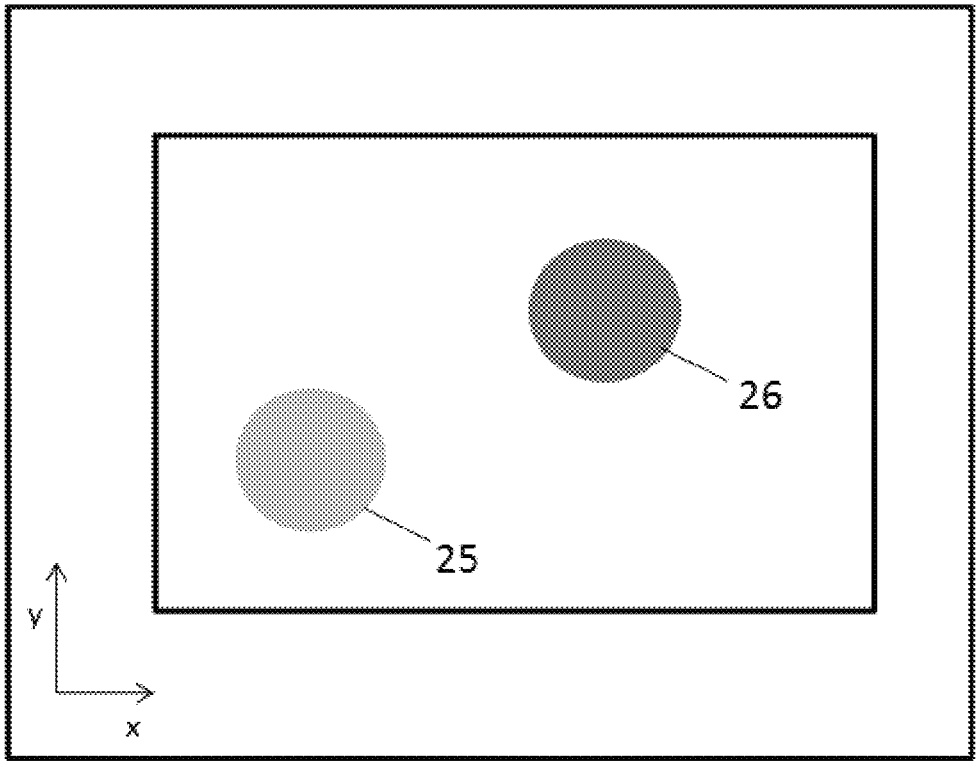
FIG. 8 is an example of a graphical user interface on the remote electronic device.

In reference to FIG. 8, a graphical user interface (GUI) is included on the remote electronic device to display information about the stool to the user. For example, the GUI may show the movement profile of the stool. The GUI may also include an indicator to track the position of the stool. Such an indicator may take the form of an avatar on the GUI. In one non-limiting example, the actual position data of the stool is displayed in comparison to the avatar, which is positioned at an ideal position of the stool.

The remote electronic device may further include one or more interactive applications or programs for increasing and/or stimulating the use of the pendula stool. The application(s) and/or program(s) may be stored on a memory, which may be stored in the remote electronic device. The application(s) or program(s) operate as a mechanism for participation where the user performs an activity associated with the pendula stool. In one non-limiting example, the user is required to align a scale mark or spot (25), such as a circle, associated with the positioning of the stool, with a second scale mark or spot (26) that represents a goal. In order to align both scale marks, the user needs to move and change his position while on the stool. Such activities can be utilized as recreational exercises and/or for physical therapy. By providing the user with a goal, the above described activity simultaneously pairs amusement and/or distraction with a physical training exercise. In another example, the user specific avatar may be utilized on the GUI to instruct the user's movement on the pendula stool as another form of physical therapy.

Figure 9:
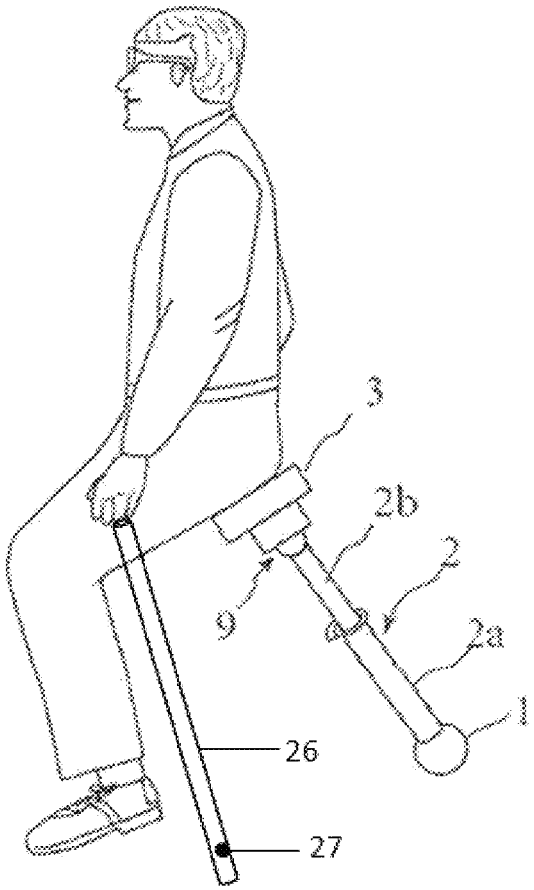
FIG. 9 is a perspective view of a user utilizing a support device while seated on the dynamic pendula stool according to the invention.

Additional accessories may also be provided to facilitate the user's experience with the pendula stool. For example, poles or sticks (26) can be used as supports to assist the user in finding the optimal balance with the stool as shown in FIG. 9. These supports (26) can include one or more of any of the sensors (27) described herein for collecting pressure, position, and/or tilt data. Like the sensors incorporated in the stool, the sensor(s) included in the pole or stick supports (26) are configured to continuously collect and transmit information to a remote electronic device. The remote electronic device may be the same remote electronic device that communicates with the pendula stool or it may be another remote electronic device that communicates separately with the support(s).

Lastly, it is evident that the above examples are only particular illustrations and do not restrict the scope of the application field of the invention.

The invention claimed is:

1. A dynamic pendula stool with a foot, a column secured to said foot and a seat secured to an upper end of said column, wherein the column comprises a telescopic column with a lower part secured to a spherical foot with a diameter of 20 cm or less, and an upper part, having an end with an articulation with three degrees of freedom and secured to a lower side of the seat, such that, when a user sits on the seat, the column forms an angle between 30° and 90° relative to a horizontal surface, which allows an isometric contraction of muscle groups of the user's lower limbs and abdominal girdle in the seated position.

2. The stool according to claim 1, wherein the spherical foot is made of an anti-slip material.

3. The stool according to claim 2, wherein the spherical foot is made of an elastomer.

4. The stool according to claim 1, wherein the spherical foot includes a radially extending sleeve with an internal thread in cooperation with a threaded rod that is secured to a lower end of the lower part of the column.

5. The stool according to claim 1, wherein the articulation comprises a ball joint.

6. The stool according to claim 1, wherein the articulation comprises a universal joint.

7. The stool according to claim 1, wherein an upper end of the lower part of the column includes a quick-release clamp.

8. The stool according to claim 1, wherein the seat has a substantially parallelepiped shape.

9. The stool according to claim 1, further comprising one or more sensors configured to transmit data signals of position and/or pressure information to a remote electronic device.

10. A system of monitoring use of a dynamic pendula stool, comprising:

a dynamic pendula stool having a foot, a column secured to said foot and a seat secured to an upper end of said column, wherein the column comprises a telescopic column with a lower part secured to a spherical foot with a diameter of 20 cm or less, and an upper part having an end with an articulation with three degrees of freedom and secured to a lower side of the seat, such that, when a user sits on the seat, the column forms an angle between 30° and 90° relative to a horizontal surface, which allows an isometric contraction of muscle groups of the user's lower limbs and abdominal girdle in the seated position;

a position sensor positioned on the column or spherical foot to detect an inclination of the stool;

a remote electronic device, and wherein the position sensor is configured to transmit data signals of position information to the remote electronic device.

11. The system according to claim 10, wherein the transmitted data signals are processed by the remote electronic device to determine positioning of the stool in relation to one or more predefined reference points or to determine an angle of a direction of movement of the stool and/or a speed of movement of the stool.

12. The system according to claim 10, wherein the remote electronic device is one of a smartphone, a computer, or a digital tablet.

13. The system according to claim 10, wherein the remote electronic device uses the detected inclination of the stool to scroll a menu on the remote electronic device.

14. The system according to claim 10, further comprising: a position sensor positioned below the seat or the articulation, a pressure sensor configured to detect a load applied to the stool and to transmit data signals of pressure information to the remote electronic device, and wherein the remote electronic device is configured to determine when the detected load exceeds a predetermined threshold.

15. The system according to claim 14, wherein the remote electronic device compares the detected load to values stored in a validation menu on the remote electronic device, and uses the detected inclination of the stool to scroll a menu on the remote electronic device.

16. The system according to claim 10, wherein the remote electronic device processes the transmitted data signals to determine a discrete position of the stool, a progression of movement of the stool, and/or a center of gravity.

17. The system according to claim 10, wherein the remote electronic device includes a graphical user interface for displaying positioning and/or movement information of the stool, the graphical user interface having an indicator that is displayed at a preset ideal position of the stool specific to the user, and wherein the position data of the stool determined by the remote electronic device from the transmitted data signals is displayed in comparison to the indicator on the graphical user interface.

18. The system according to claim 17, wherein the remote electronic device further includes one or more interactive applications or programs for increasing and/or stimulating the use of the stool by the user, and wherein the indicator is used in the one or more interactive applications or programs to instruct the user's movement on the stool.

19. The system according to claim 17, wherein the indicator is an avatar.

20. The stool according to claim 1, further comprising a support to assist the user, the support including one or more sensors configured to transmit data signals of position and/or pressure information to a remote electronic device.

21. The system according to claim 10, further comprising a support to assist the user, the support including one or more sensors configured to transmit data signals of position and/or pressure information to another remote electronic device.

22. A method of controlling the remote electronic device of the system claim 10, comprising:

transmitting data signals of position and/or pressure information from the stool to the remote electronic device;

processing the transmitted data signals to convert information contained in the data signals into a command signal; and activating a menu or application stored on the remote electronic device based on the command signal.

* * * * *